US007712989B2

(12) United States Patent
Yasui et al.

(10) Patent No.: US 7,712,989 B2
(45) **Date of Patent: *May 11, 2010**

(54) INK JET RECORDING APPARATUS CAPABLE OF PERFORMING A DUPLEX PRINT OPERATION

(75) Inventors: Motokazu Yasui, Yokohama (JP); Tsumori Sato, Miura (JP); Masanori Horike, Yokohama (JP); Masato Yokoyama, Tokyo-to (JP); Masumi Sato, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/298,890

(22) Filed: Dec. 12, 2005

(65) Prior Publication Data

US 2006/0087547 A1 Apr. 27, 2006

Related U.S. Application Data

(63) Continuation of application No. 10/789,152, filed on Feb. 27, 2004, now Pat. No. 7,344,326, which is a continuation of application No. 10/218,471, filed on Aug. 14, 2002, now Pat. No. 6,719,469, which is a continuation of application No. 09/330,669, filed on Jun. 11, 1999, now abandoned.

(30) Foreign Application Priority Data

Jun. 12, 1998 (JP) ..... 10-165331

(51) Int. Cl.
*B41J 11/54* (2006.01)

(52) U.S. Cl. ..... 400/635; 400/603

(58) Field of Classification Search ..... 400/603, 400/602, 635, 624, 625, 603.1, 634; 271/184–160, 271/90

See application file for complete search history.

(56) References Cited

U.S. PATENT DOCUMENTS

| | | | | |
|---|---|---|---|---|
| 4,307,958 | A | | 12/1981 | McIrvine |
| 4,751,527 | A | * | 6/1988 | Oda ..... 347/66 |
| 4,806,979 | A | * | 2/1989 | Tokoro et al. ..... 399/401 |
| 4,974,033 | A | * | 11/1990 | Yamada et al. ..... 399/124 |
| 5,008,713 | A | * | 4/1991 | Ozawa et al. ..... 399/402 |
| 5,225,881 | A | | 7/1993 | Goto et al. |
| 5,280,331 | A | | 1/1994 | Namiki |
| 5,339,139 | A | | 8/1994 | Fullerton et al. |
| 5,448,348 | A | | 9/1995 | Azeta |

(Continued)

FOREIGN PATENT DOCUMENTS

JP 3-24350 2/1984

(Continued)

*Primary Examiner*—Anthony H. Nguyen
(74) *Attorney, Agent, or Firm*—Oblon, Spivak, McClelland, Maier & Neustadt, L.L.P.

(57) ABSTRACT

An ink jet recording apparatus performs a print operation by controlling an ink jet recording head to eject ink drops there from against front and back surfaces of a recording sheet at a print position. The apparatus includes a transporting mechanism for transporting a portion of the recording sheet to a location outside of the apparatus after a completion of the print operation on the front surface of the recording sheet and just before printing of the back surface of the recording sheet.

12 Claims, 15 Drawing Sheets

U.S. PATENT DOCUMENTS

| | | | | |
|---|---|---|---|---|
| 5,486,911 | A | 1/1996 | Rubscha et al. | |
| 5,504,568 | A * | 4/1996 | Saraswat et al. | 399/364 |
| 5,926,681 | A | 7/1999 | Ishimaru | |
| 6,000,867 | A | 12/1999 | Yoshii et al. | |
| 6,002,912 | A * | 12/1999 | Takeda | 399/405 |
| 6,029,020 | A | 2/2000 | Blackman et al. | |
| 6,032,941 | A * | 3/2000 | Endo | 271/3.19 |
| 6,102,506 | A | 8/2000 | Sasai et al. | |
| 6,128,463 | A * | 10/2000 | Matsumoto et al. | 399/364 |
| 6,145,834 | A | 11/2000 | Hirota et al. | |
| 6,697,177 | B1 | 2/2004 | Tomoe et al. | |

FOREIGN PATENT DOCUMENTS

| | | |
|---|---|---|
| JP | 59-031178 | 2/1984 |
| JP | 62-51516 | 3/1987 |
| JP | 2-126849 | 10/1990 |
| JP | 3-73769 | 3/1991 |
| JP | 04-125236 | 4/1992 |
| JP | 05-131696 | 5/1993 |
| JP | 05-193213 | 8/1993 |
| JP | 06-071956 | 3/1994 |
| JP | 06-134982 | 5/1994 |
| JP | 6-297716 | 10/1994 |
| JP | 07-323637 | 12/1995 |
| JP | 08-012203 | 1/1996 |
| JP | 8-267846 | 10/1996 |
| JP | 08-337011 | 12/1996 |
| JP | 9-263353 | 10/1997 |
| JP | 10-109447 | 4/1998 |
| JP | 11-335007 | 12/1999 |
| JP | 3412954 | 3/2003 |

* cited by examiner

INK JET RECORDING APPARATUS CAPABLE OF PERFORMING A DUPLEX PRINT OPERATION

CROSS-REFERENCES TO RELATED APPLICATIONS

This application claims priority from, and is a continuation of U.S. patent application Ser. No. 10/218,472, filed Aug. 14, 2002, which was a continuation of application Ser. No. 09/330,669, filed Jun. 11, 1999, each of which is incorporated by reference herein.

BACKGROUND OF THE INVENTION

This invention relates to an ink jet recording apparatus, and more particularly to an ink jet recording apparatus which is capable of performing a duplex print operation such that printing is performed on both sides of a sheet of paper.

An ink jet recording apparatus has been used widely as an image forming mechanism in printers, copying machines, and so on. Some ink jet recording apparatuses are capable of operating in a duplex print mode in which a print operation can be performed on both sides of the recording sheet. One example of such a printer is described in Japanese Laid-Open Patent Publication No. JPAP08-337011 (1996). The ink jet recording apparatus according to this example is adapted to perform a duplex print operation by using two recording mechanisms which are positioned in the ink jet recording apparatus so as to be spaced apart from each other. Accordingly, the structure of the ink jet recording apparatus becomes complex and the apparatus itself becomes relatively large and expensive because of the use of two recording mechanisms, as well as, a plurality of paper transportation mechanisms required therein. As a result, the cost of manufacturing such a duplex mode printer is greatly increased.

In addition, such an apparatus may have a disadvantage with respect to the quality of a print image. This is because in the above-mentioned ink jet recording apparatus, the sheet is transported to the second recording mechanism while the printed surface of the sheet contacts or is rubbed against a surface of a guide plate connecting the first recording mechanism to the second recording mechanism. Yet, with ink jet recording, time is required to dry the printed surface and, therefore, the printed surface should be protected from contacting any material or any object that might smudge or affect the quality of the printed image on the sheet.

SUMMARY OF THE INVENTION

In order to overcome the problems described above, preferred embodiments of the present invention provide an ink jet recording apparatus which has a very small size and is constructed to print high quality printed sheets in a duplex print mode such that both sides of a sheet are printed.

Further, preferred embodiments of the present invention provide a method and apparatus for ink jet printing in which two sides of a sheet can be printed by ink jet printing but using only a single ink jet print head, thereby eliminating the need for two ink jet print head or printing units as is required in conventional devices. That is, preferred embodiments of the present invention provide a method and apparatus for ink jet printing in which two sides of a sheet can be printed by the same ink jet print head.

In addition, preferred embodiments of the present invention provide a method of ink jet printing on both sides of a sheet such that a sheet that has been printed on one side is fed to a location outside of the printer and then is fed back into the printer to have the second side of the sheet printed.

In addition, preferred embodiments of the present invention provide a method and apparatus for ink jet printing in which a pair of exit rollers are capable of being driven in a reverse direction so as to feed a sheet that has been printed on one side thereof back into the printer so that the second side of the sheet can be printed.

Additional preferred embodiments provide an ink jet printing apparatus in a sheet diverting mechanism diverts the feed of a sheet that has been printed on one side thereof so that the sheet is printed on the second side thereof.

According to one preferred embodiment of the present invention, an ink jet recording apparatus performs a print operation by controlling an ink jet recording head so as to eject ink drops there from onto front and back surfaces of a recording sheet. The ink jet recording apparatus transports a portion of the recording sheet to a location outside of the apparatus after a completion of the print operation on the front surface of the recording sheet and before the print operation on the rear surface of the recording sheet.

The portion of the recording sheet transported to the location outside of the apparatus may include a surface that has the ink drops disposed thereon.

The recording sheet which has been printed on the front surface thereof may be reversely transported to the print position again using a switchback mechanism.

The location outside of the apparatus may be positioned below the print position or may be an upper surface of an input sheet cassette that contains a plurality of recording sheets.

The recording sheet may be transported to the print position by a transport mechanism that includes a transport belt.

The recording sheet may be moved at a speed which is substantially the same as a moving speed of the transport belt when the recording sheet is reversely transported to the print position again.

The apparatus may have a single print mechanism that includes the ink jet recording head.

Drying elements such as a fan, heater or timing controlled sheet feeding mechanism may be provided in the printer for ensuring that the one-side-printed sheet is dried before the sheet is fed back into the printer for printing of the second side.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
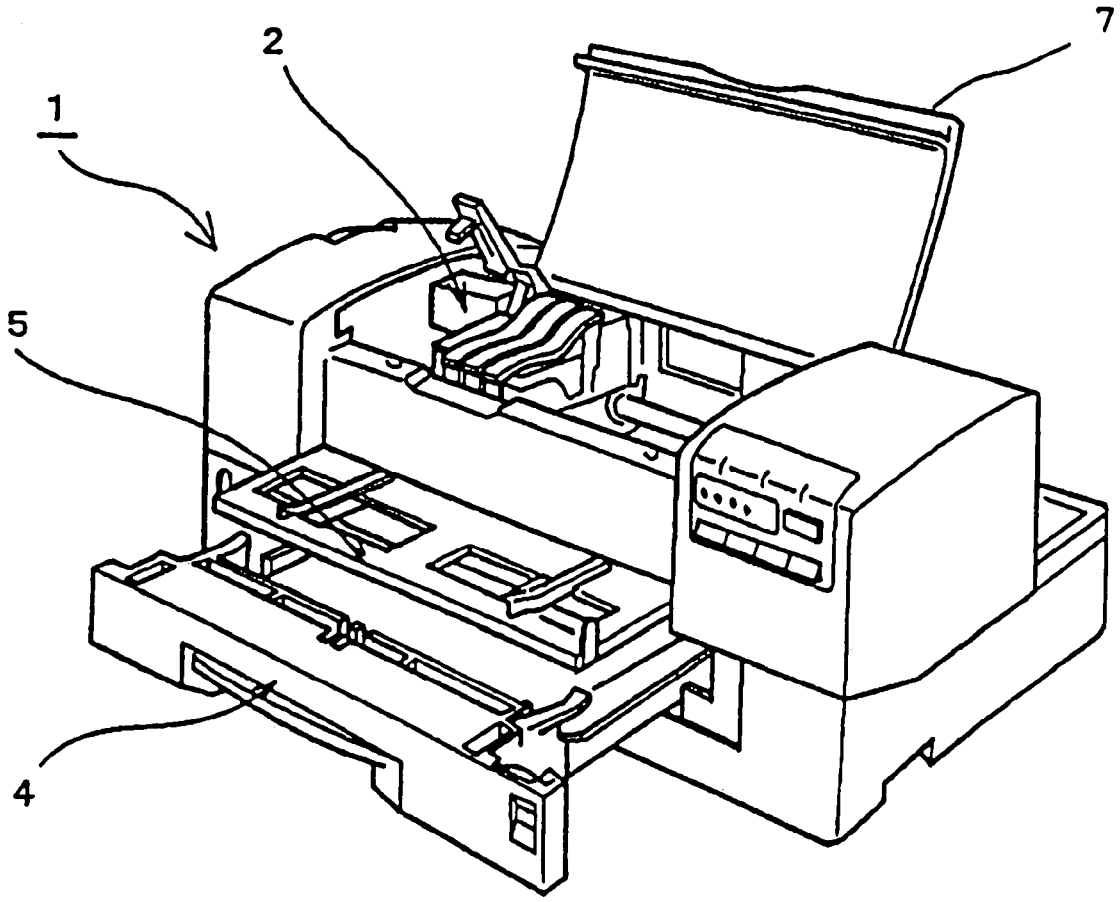
FIG. 1 is an illustration of a perspective front view of an ink jet printer according to a preferred embodiment of the present invention.

Referring now to the drawings, wherein like reference numerals designate identical or corresponding parts throughout the several views, and more particularly to FIG. 1 thereof, front and rear perspective views of an ink jet printer 1 according to a preferred embodiment of the present invention are illustrated, respectively. The ink jet printer 1 shown in FIG. 1 includes an ink jet print unit 2. As will be described in more detail below, only a single ink jet print unit is required to achieve two-sided printing as opposed to the conventional device in which two such ink jet print units are required to achieve two-sided printing. Thus, the printer 1 preferably only has a single ink jet print unit 2.

Figure 2:
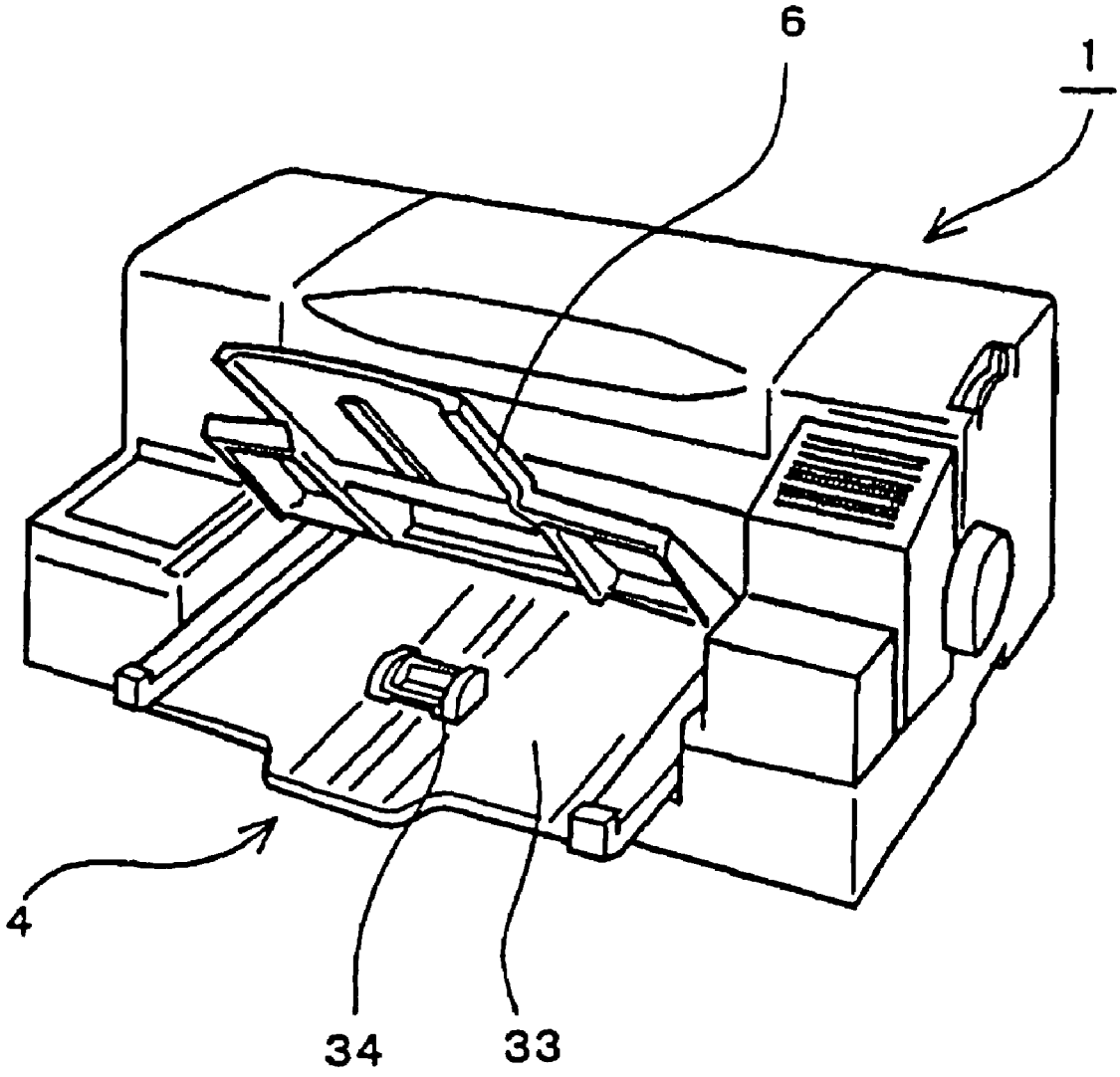
FIG. 2 is an illustration of a perspective rear view of the ink jet printer of FIG. 1.

The printer 1 also includes an input sheet cassette 4, a manual input tray 5, an output sheet tray 6 (see FIG. 2), and an upper cover 7. The print unit 2 is installed under the upper cover 7 inside of the ink jet printer 1 such that an operator can access the print unit 2 when the upper cover 7 is opened (see chain lines A in FIG. 4). The print unit 2 includes various elements (FIG. 3), such as a carriage 13 which is movable in the main scanning direction of the print unit 2, an ink jet recording head 14 which is mounted on the carriage, an ink cartridge 15 arranged to supply ink to the ink jet recording head.

The input sheet cassette 4 shown in FIG. 1, which can alternatively be a tray type, can hold a plurality of sheets 3. The input sheet cassette 4 is installed inside the lower part of the ink jet printer 1 from the front side of the ink jet printer 1 when the input sheet cassette 4 has the sheets 3 therein, and is movable outwardly when no sheet is contained therein so that new sheets can be inserted therein. The manual input tray 5 is rotatably mounted in the front of the ink jet printer 1, above the input sheet cassette 4. The manual input tray 5 allows an occasional use of different sheets when it is set in an open position. The output sheet tray 6 (FIG. 2) is mounted on the rear side of the ink jet printer 1, and receives the sheets 3 which are ejected after a printing operation performed by the printer unit 2 is finished.

In this ink jet printer 1, the sheet 3 which is selected either from the input sheet cassette 4 or the manual input tray 5 is transported to the print unit 2 which then records an image on one side of the sheet 3. Then, the one-side-printed sheet is ejected to the output sheet tray 6. This is similar to a normal printing operation in a conventional printer that prints on only side of a sheet.

Figure 3:
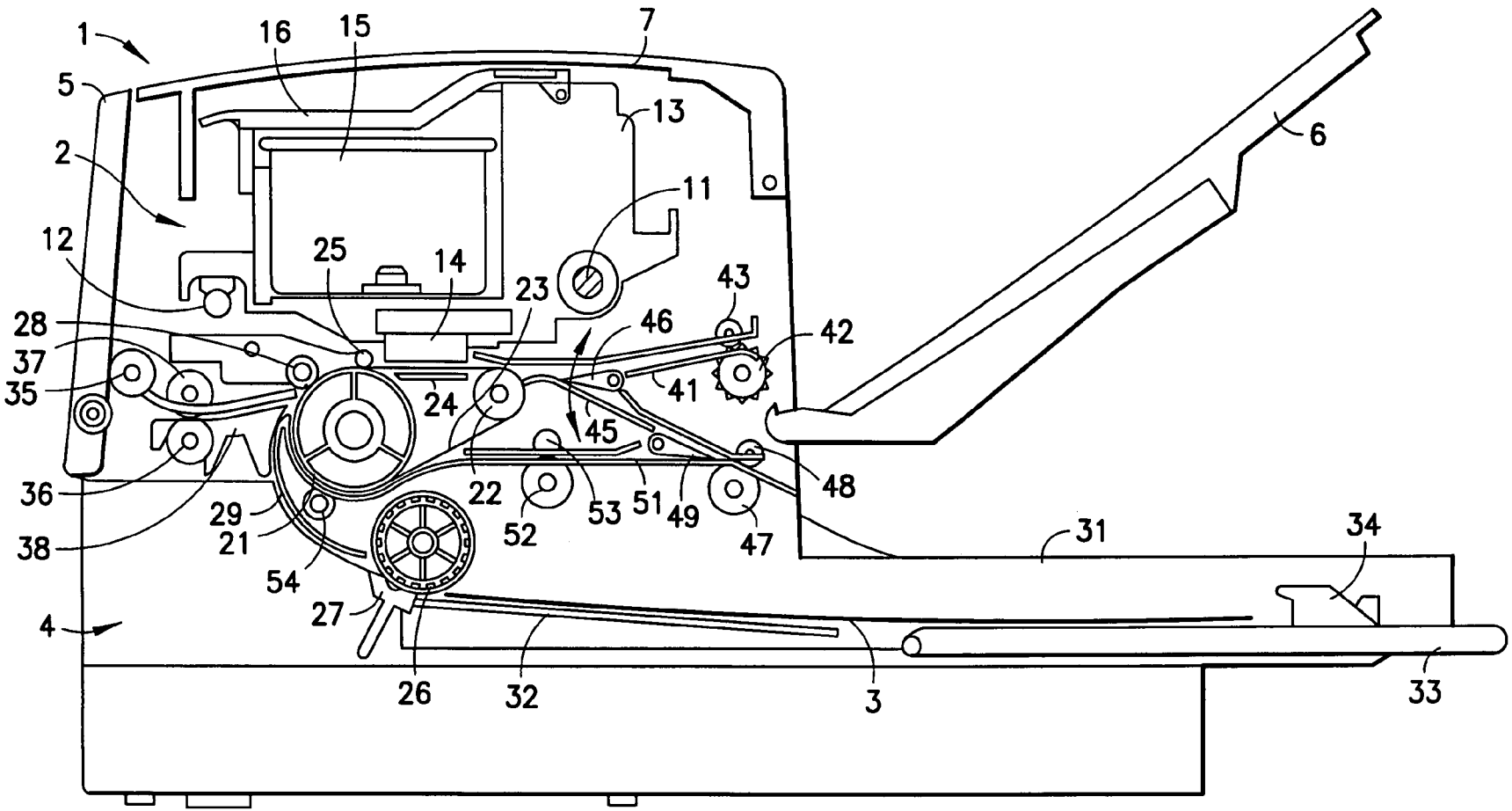
FIG. 3 is an illustration for explaining a mechanical structure of the ink jet printer of FIG. 1.

As illustrated in FIG. 3, the carriage 13 is slidably supported by a main guide rod 11 in the front and a sub-guide rod 12 at the rear thereof, wherein both the main guide rod 11 and the sub-guide rod 12 bridge left and right side plates (not shown) of the ink jet printer 1. The carriage 13 can thus slide in the main scanning direction (vertical direction relative to the drawing of FIG. 3). The ink jet recording head 14 may be a single color print head (black) or may preferably have nozzles (not shown) for ejecting yellow (Y), cyan (C), magenta (M), and black (B) ink drops. The head 14 is mounted on the bottom surface of the carriage 13 such that the nozzles can eject ink drops in a downward direction. The carriage 13 is provided on the top surface thereof with disposable ink tanks 15 (i.e., ink cartridges) for supplying the color ink to the respective nozzles. The ink tanks 15 are secured to the carriage 13 by a support lever 16. To release the ink tanks 15, the support lever 16 is unhooked and rotated (see chain lines B of FIG. 4).

Alternatively, the ink jet recording head 14 may be replaced by a plurality of recording heads, aligned in the main scanning direction, each for ejecting each color ink or a recording head having a single nozzle for ejecting a plurality of different color inks. Of course, a single color (black) ink jet head may also be provided alone or in combination with other print heads.

Under the print unit 2, a main transport roller 21 and a sub-transport roller 22 are provided such that a transport belt 23 movably stretched there between can transport the sheet 3 to a print position located immediately under the nozzles of the ink jet recording head 14. Electrostatic force is used for the transportation of the sheet 3 by the transport belt 23. A platen plate 24 is provided at a position opposed to the ink jet recording head 14 and positioned relative to the transport belt 23. Preferably, the main transport roller 21 has a sufficiently large diameter (i.e., about 30 mm or more) to generate enough electrostatic force so as to prevent the sheet 3 from separating from the transport belt 23 during the turning period around the main transport roller 21 of the transportation movement. The transport belt 23 preferably is made of medium resistance substance having a volume resistance range of $10^9$ Ωcm to $10^{12}$ Ωcm. In addition, a transportation direction regulating roller 25 is mounted at a location before the print position on the transport belt 23, pressing the main transport roller 21 via the transport belt 23 and regulating the transportation direction of the sheet 3 so that the sheet 3 is transported in the direction that the transport belt 23 moves.

The sheet 3 in the input sheet cassette 4 is picked up and fed into a transportation path in the ink jet printer 1 via a pick-up roller 26 and a friction pad 27. The sheet 3 is then transported along a guide plate 29 to a midway roller 28, located before the transportation direction regulating roller 25 on the periphery of the main transport roller 21, for pressing the sheet 3 onto the surface of the transport belt 23. Thereby, the sheet 3 from the input sheet cassette 4 is transported to the transport belt 23 which will further transport the sheet 3 to the print position. The input sheet cassette 4 includes a cassette main body 31, a bottom plate 32, and an extension bottom plate 33.

The sheets 3 are placed on a planar surface defined by the bottom plate 32 and the extension bottom plate 33. Such a planar surface for receiving and holding the sheets 3 can be extended by changing the position of the extension bottom plate 33 (see chain lines C in FIG. 4), thereby making it possible to use a sheet having a length longer than the cassette main body 31. In addition, an end fence 34 is mounted on the upper surface of the extension bottom plate 33. The end fence 34 can be slid in a stepless manner and can be set at any position within the width of the cassette main body 31 in the vertical direction of the drawing of FIG. 3.

Also, the sheet 3 which is inserted from the manual input tray 5 when the manual input tray 5 is in an open position (see chain lines D in FIG. 4) is picked up and fed into another transportation path in the ink jet printer 1 via a manual input pick-up roller 35 and a pair of manual input transportation rollers 36 and 37. The sheet 3 is then transported along a manual input guide plate 38 to the midway roller 28. Thereby, the sheet 3 from the manual input tray 5 is transported to the transport belt 23 which will further transport the sheet 3 to the print position.

After having passed the print position, the sheet 3 is transported along an ejection guide plate 41 to an ejection main roller 42 and an ejection sub-roller 43. The sheet 3 is then ejected to the output sheet tray 6 via the ejection main roller 42 and the ejection sub-roller 43. The rollers 42 and 43 are at an ejection position. The output sheet tray 6 can be extended as indicated by broken lines E in FIG. 4.

In addition to the above sheet ejection path, the present preferred embodiment has another sheet ejection path which is directed to a location between the output sheet tray 6 and the input sheet cassette 4 and is used for the sheet ejection after a front side print operation in a duplex print mode. It should be noted that the location for feeding the one-side-printed sheet outside of the printer before the one-side-printed sheet is fed back into the printer for printing of the second side, can be positioned at a variety of different locations and is not limited to the location shown in FIGS. 3 and 4. As will be described below, the output sheet tray 6 may be used for supporting the one-side-printed sheet before the sheet is fed back into the printing of the second side. Also, other locations and supports for the one-side-printed sheet may be used and may be located at different positions.

A sheet diverting mechanism is provided for achieving the two-sided printing. More specifically, a first path-selection pawl 46 is mounted to switch between these two sheet ejection paths. Accordingly, the first path-selection pawl 46 is rotated in the simplex or one-side-only print mode so that the tip thereof is set in a lower position, thereby selecting the sheet ejection path for ejecting printed sheets to the output sheet tray 6. In the duplex or two-sided print mode, the first path-selection pawl 46 is rotated so that the tip thereof is set at an upper position, thereby selecting the sheet ejection path for the duplex print operation.

In the duplex mode, after the sheet has passed the print position for the front side print operation, the sheet 3 is transported along a duplex ejection guide plate 45 to a duplex switchback main roller 47 and a duplex switchback sub-roller 48. The sheet 3 is further transported towards a duplex transit tray provided on the upper surface of the input sheet cassette 4 via the duplex switchback main roller 47 and the duplex switchback sub-roller 43. The duplex switchback main roller 47 is stopped at a predetermined timing so as to keep holding the sheet 3 at the trailing edge thereof, and is reversely driven to start transportation of the sheet 3 for the print operation on the back side of the sheet 3.

A second path-selection pawl 49 is provided upstream of the duplex switchback main roller 47 and the duplex switchback sub-roller 43 in the sheet ejection path along the duplex ejection guide plate 45. The second path-selection pawl 49 switches between the sheet ejection path and a duplex print path formed underneath the sheet ejection path. Accordingly, when the sheet 3 is transported to the duplex transit tray, the second path-selection pawl 49 is rotated so that the tip thereof is set at a lower position. Thereby, the sheet ejection path to the duplex transit tray is selected. When the sheet 3 is transported from the duplex transit tray towards the duplex print path, the second path-selection pawl 49 is rotated so that the tip thereof is set in an upper position. Thereby, the duplex print path for the duplex print operation is selected.

After having started the reverse rotation, the duplex switchback main roller 47 and the duplex switchback sub-roller 48 transport the sheet 3 along a duplex guide plate 51 to a duplex main roller 52 and a duplex sub-roller 53. The sheet 3 then contacts the transport belt 23, and is further transported to a transportation sub-roller 54 and to the midway roller 28 by the duplex main roller 52 and the duplex sub-roller 53. Thus, the sheet 3 can be transported to the print position so as to be printed on the back side thereof.

Figure 5:
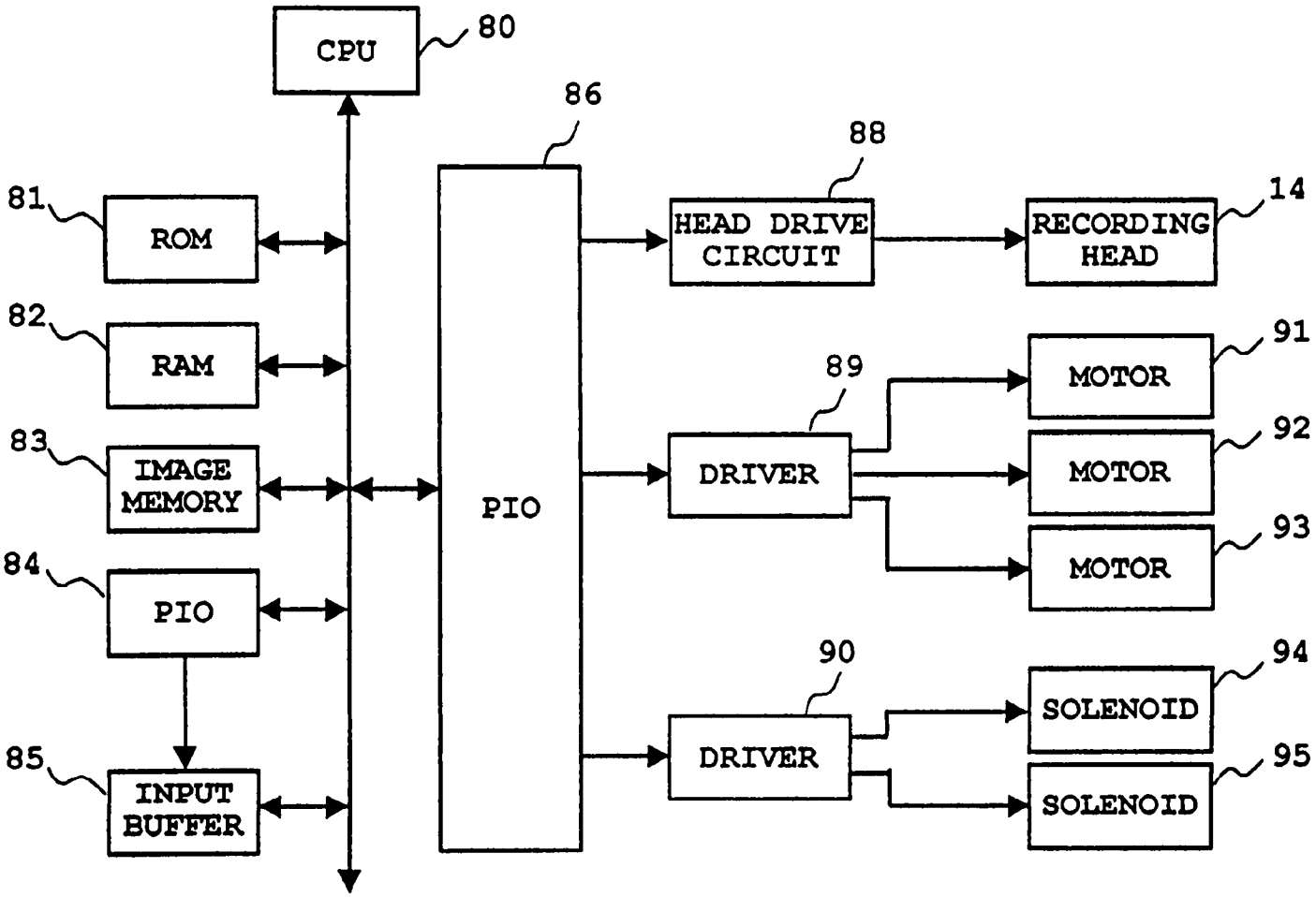
FIG. 5 is a block diagram of a control unit of the ink jet printer of FIG. 1.

Next, an exemplary hardware configuration of a control unit of the ink jet printer 1 is explained with reference to FIG. 5. As shown in FIG. 5, the control unit of the ink jet printer 1 includes a CPU (central processing unit) 80 for controlling all of the operations of the ink jet printer 1, and a ROM (read only memory) 81 for storing various kinds of information (including programs) related to the operations of the ink jet printer 1. The control unit further includes a RAM (random access memory) 82 used as a working memory and the like, and an image memory 83 for storing data of processed image information. The control unit further includes a PIO (parallel input and output) port 84, an input buffer 85, another PIO port 86, a head drive circuit 88, and drivers 89 and 90.

The PIO 84 receives image information sent from a host system as well as information for indicating whether printing is to be done in a simplex or one-side only print mode or a duplex or two-sided print mode, a size of sheet used, commands sent from a console panel (not shown), signals sent from various kinds of sensors such as a home position sensor for detecting a home position of the carriage 13, and so forth. In addition, the PIO 84 sends information to the host system and console panel.

The head drive circuit 88 drives the recording head 14 which includes energy generating devices corresponding to the Y, M, C, and B color nozzles. Each energy generating device preferably includes an electronic-to-mechanical transducer such as a piezoelectric transducer or an electronic-to-heat transducer such as a heating resistor. When driving the recording head 14, the head drive circuit 88 selects at least one energy generating device from among all the energy generating devices of the recording head 14 in accordance with the information sent from the CPU 80 via the PIO 86 and applies a drive waveform to each selected energy generating device. In this way, the corresponding nozzles are driven. The drive waveform may be a square wave, a deltaic wave, a sine wave, etc.

The driver 89 drives a motor 91 for moving the carriage 13 in the main scanning direction, a motor 92 for rotating the main transport roller 21 in the sub-scanning direction, a motor 93 for rotating the duplex switchback main roller 47, in accordance with the information sent from the CPU 80 via the PIO 86. The driver 90 drives solenoids 94 and 95 for moving the first and second path-selection pawl is 46 and 49, respectively, in accordance with the information sent from the CPU 80 via the PIO 86.

Figure 6:
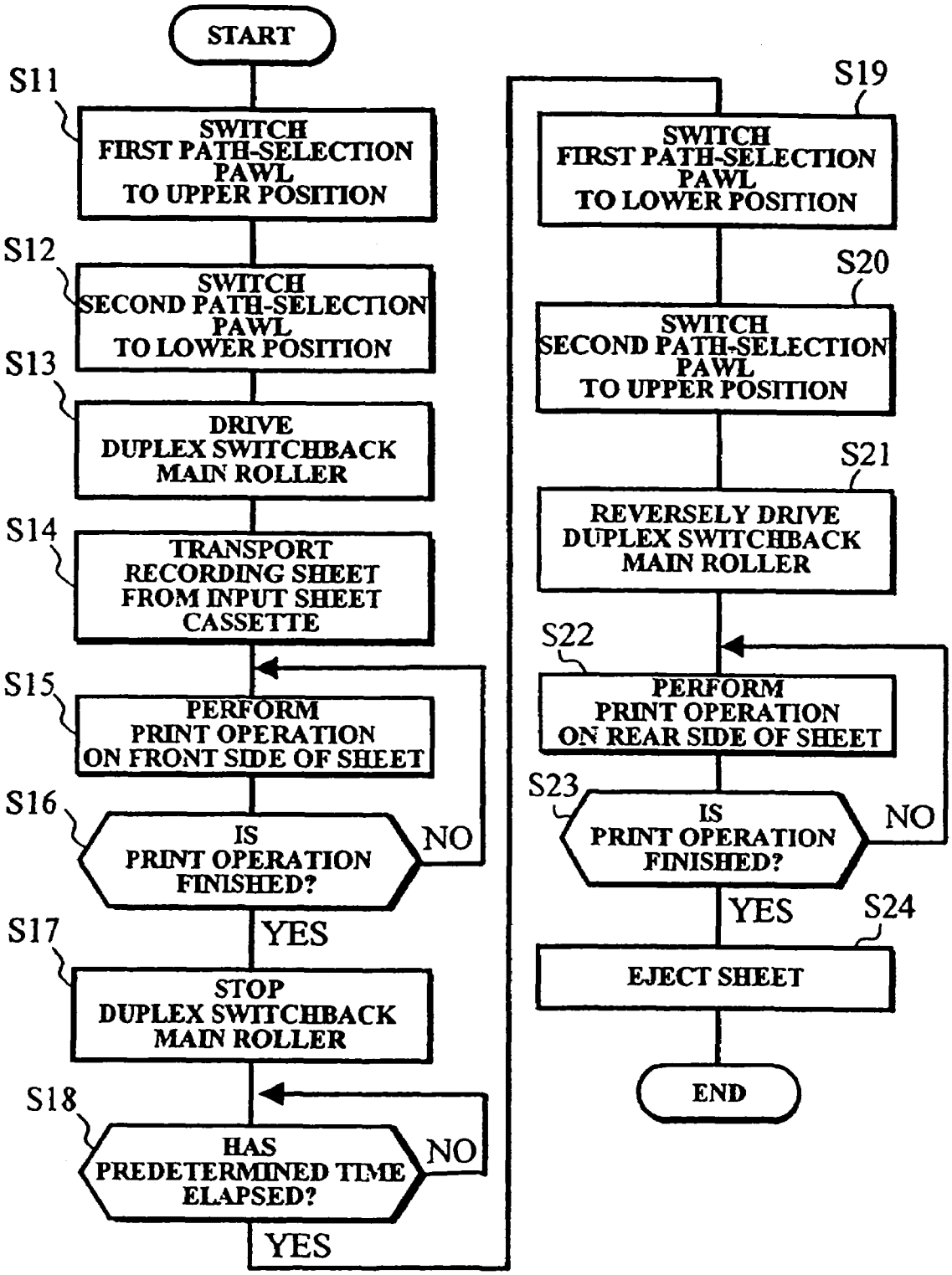
FIG. 6 is a flowchart for explaining an exemplary procedure of a duplex print operation of the ink jet printer of FIG. 1.
Figure 7:
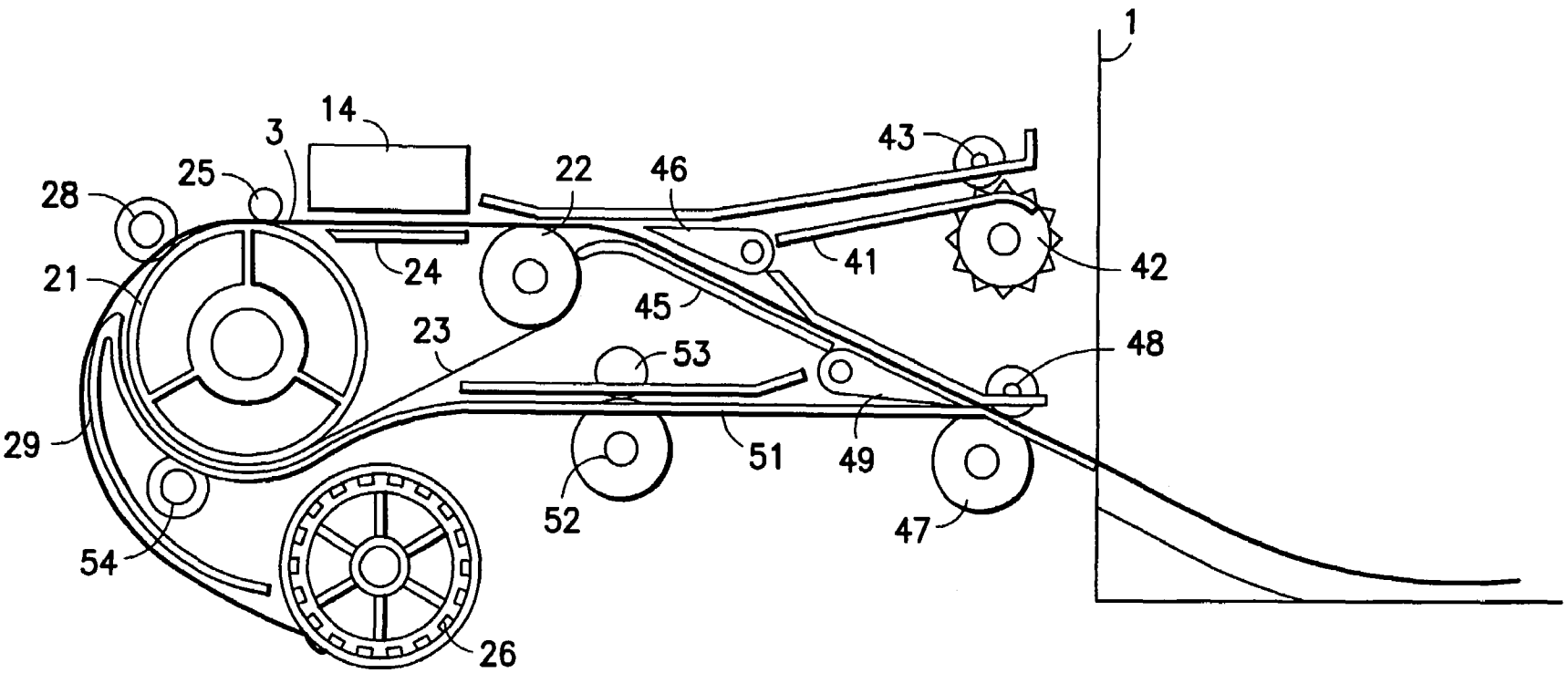
FIGS. 7-9 are illustrations for explaining different methods of switchback transportation of a recording sheet to achieve the duplex print operation.

Next, an exemplary procedure of the duplex print operation of the ink jet printer 1 is explained with reference to FIGS. 6-9. The exemplary procedure of the duplex print operation of the ink jet printer 1 is shown in a flowchart of FIG. 6. As shown in the flowchart of FIG. 6, when the duplex print mode is instructed, the first path-selection pawl 46 is switched to the upper position in Step S11, the second path-selection pawl 49 is switched to the lower position in Step S12, and the duplex switchback main roller 47 is driven in a forward rotational direction so as to rotate in the direction to transport the sheet 3 to the duplex transit tray in Step S13 (see FIG. 7).

Then, in Step S14, the pick-up roller 26 is driven to send the sheet 3 from the input sheet cassette 4, so that the sheet 3 is transported to the transport belt 23 which will then transport the sheet 3 in the sub-scanning direction via the electrostatic force. While the sheet 3 is passing through the print position underneath the ink jet recording head 14, the ink jet recording head 14 performs the print operation on the front surface of the sheet 3 in Step S15. In the print operation, the carriage 13 is moved in the main scanning direction, and the energy generating devices of the ink jet recording head 14 are driven in accordance with the recording image. Thereby, the image is printed on the front surface of the sheet 3.

Figure 4:
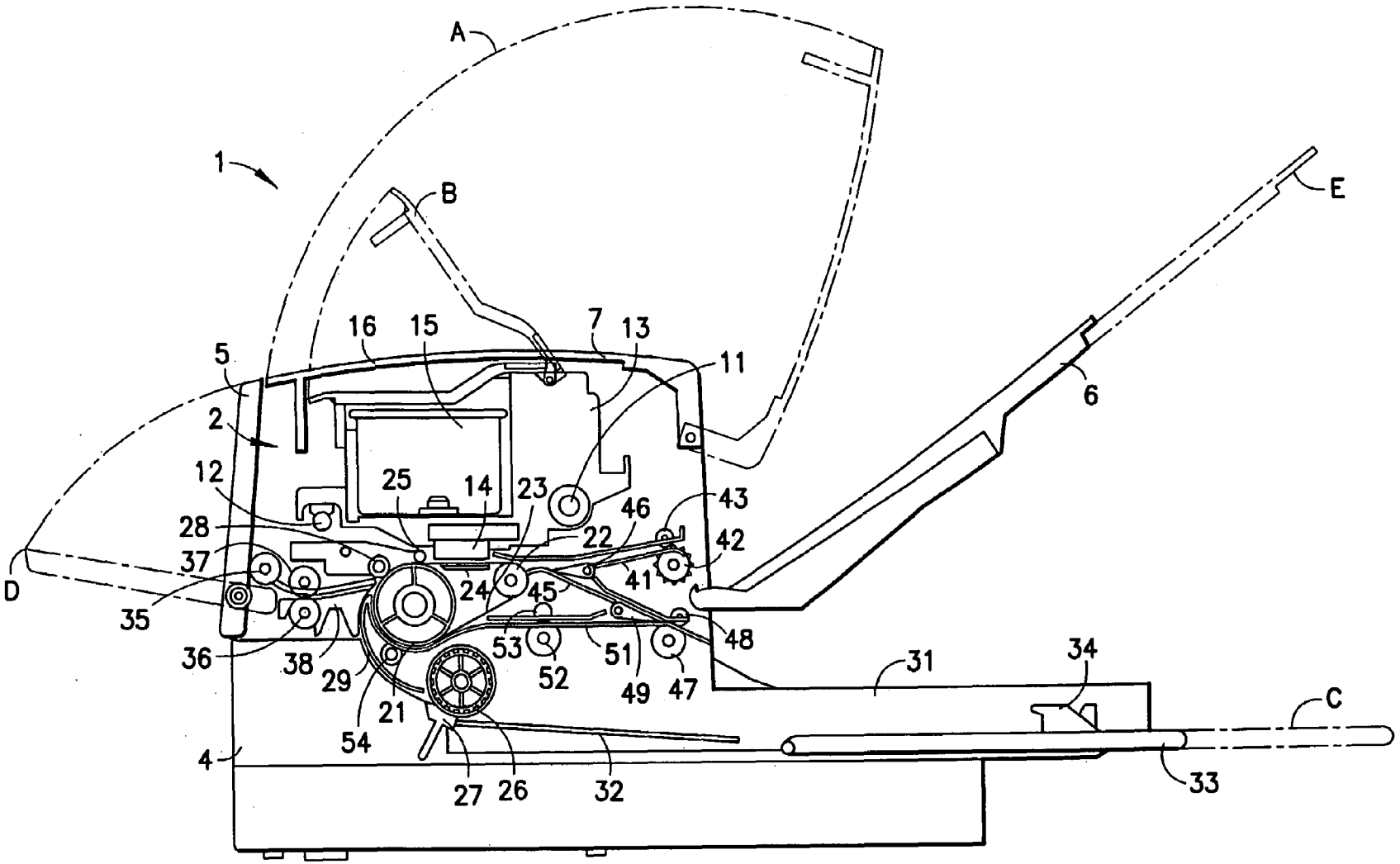
FIG. 4 is an illustration for explaining a moving component such as a manual input tray, for example.
Figure 8:
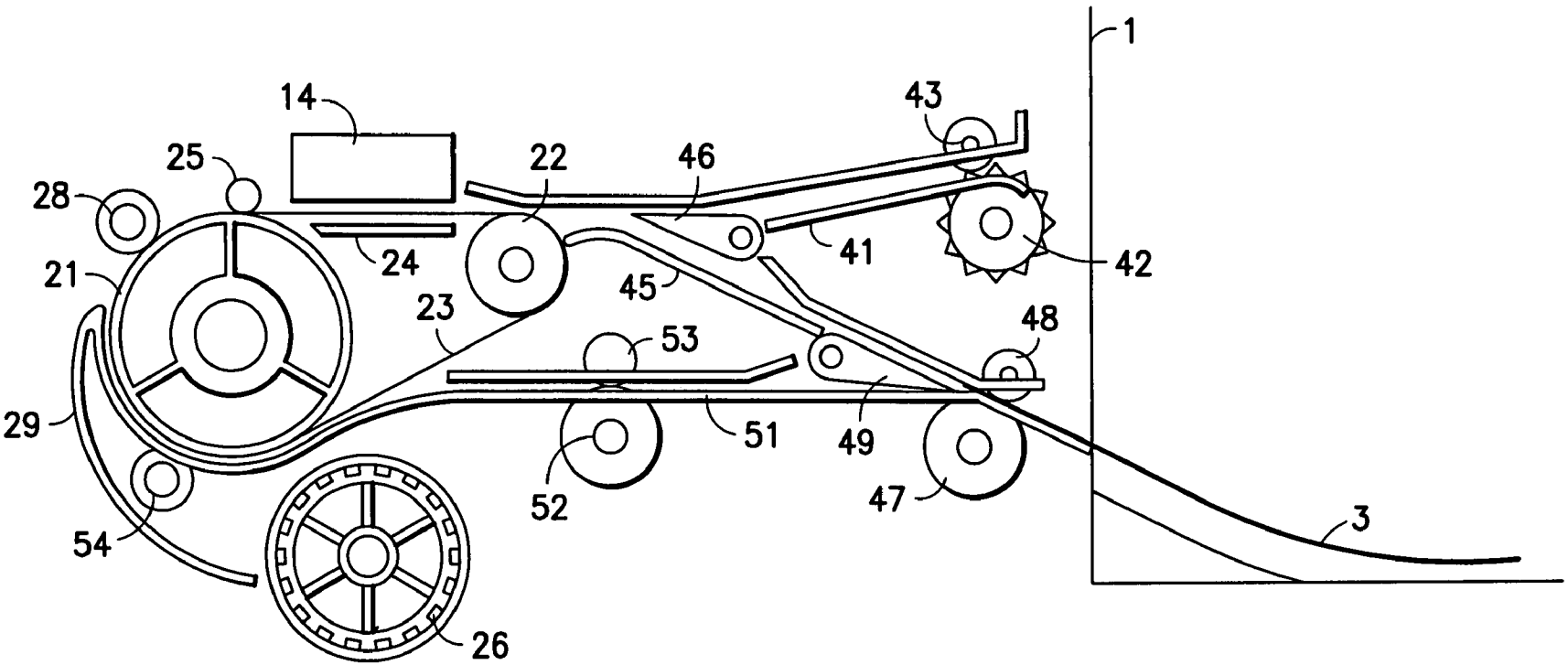

Then, the process of Step S16 checks the ink jet recording head 14 has finished the print operation on the front side of the sheet 3. The leading edge of the sheet 3 is led to the duplex ejection path and the sheet 3 itself is transported to the duplex transit tray. Thereby, the sheet 3 is ejected to a location outside of the ink jet printer 1, as illustrated in FIG. 8. After a completion of the print operation, the duplex switchback main roller 47 is stopped at a time when the trailing edge of the sheet 3 is pinched between the duplex switchback main roller 47 and the duplex switchback sub-roller 48 in Step S17, as illustrated in FIG. 8. This position at which the sheet is pinched by rollers 47 and 48 which are stopped is referred to as a drying position and the rollers 47 and 48 are a drying holding device. In FIGS. 3 and 4, it is seen that the rollers 47, 48 are below rollers 42, 43.

After the duplex switchback main roller 47 is stopped, the process of Step S18 determines if a predetermined time has elapsed from the that the print operation on the front side of the sheet 3 is completed. This predetermined time includes a time period necessary for drying the ink drops applied onto the surface of the sheet 3. Accordingly, when a drying process is not needed, the process of waiting for the elapse of the predetermined time is not needed, while in a case that the drying process is needed, some other operation can be performed during the waiting period. Also, the predetermined time can be adjusted in accordance with an amount of the ink drops used in the print operation, which can be measured by calculating the numbers of black dots including the color dots included in the image data.

Figure 9:
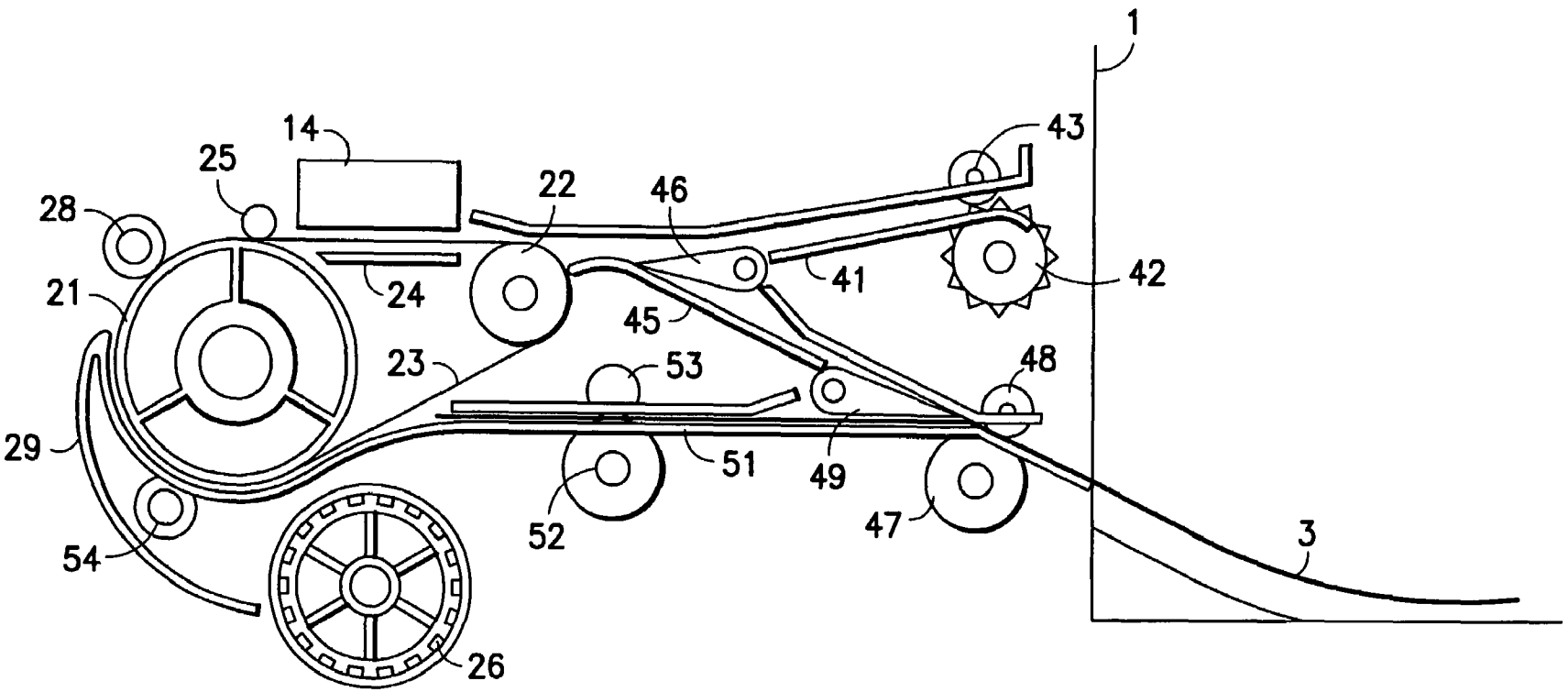

When the predetermined time has elapsed from the time that the print operation on the front side of the sheet 3 is completed, the first path-selection pawl 46 is switched to the lower position in Step S19, the second path-selection pawl 49 is switched to the upper position in Step S20, and the duplex switchback main roller 47 is reversely driven so as to rotate in the direction to transport the sheet 3 to the duplex print path in Step S21 (see FIG. 9). Thereby, the sheet 3 is transported to the duplex print path. The sheet 3 is further transported to the transport belt 23 via the rotation of the duplex main roller 52. In this operation, the sheet 3 is transported towards the transport belt 23 at the same speed as that of the transport belt 23. Thus, the transport belt 23 can make close contact with the sheet 3 and transport the sheet 3 without making scratches on the surface thereof.

Then, while the sheet 3 is passing through the print position underneath the ink jet recording head 14, the ink jet recording head 14 performs the print operation on the back side surface of the sheet 3 in Step S22. After that, the process of Step S22 checks if the ink jet recording head 14 has finished the print operation on the back side of the sheet 3. The leading edge of the sheet 3 is led to the ejection path and the sheet 3 is transported to the output sheet tray 6. Thereby, the sheet 3 is ejected to the output sheet tray 6, as illustrated in FIG. 9.

In the manner described above, the ink jet printer 1 has a sheet transportation passage in which a portion of the sheet is transported to a location outside of the apparatus after the completion of the print operation on the front side of the sheet and is returned to the next print operation on the back side of the sheet in a switchback mode.

As a result, the ink jet printer 1 has a very simple structure and eliminates the need to have more than one ink jet recording head. In addition, the printed front surface of the sheet by the print operation can be dried during the time that the sheet is transmitted to a location outside on the duplex transit tray. Thus, the print quality is greatly improved.

In addition, the predetermined time that is advantageously used for drying the print surface of the sheet in the duplex print mode may used for performing of other operations.

Further, the duplex transit tray is preferably mounted below the print position and the sheet ejection path has a downwardly inclined slope leading to the duplex transit tray. With this configuration, the present preferred embodiment can reliably transport the sheet which has been printed on the front side thereof and is therefore, heavier because of the weight of the deposited ink drops to the duplex transit tray. In the present preferred embodiment, the duplex transit tray is not a separate mechanical component but is simply the surface of the input sheet cassette 4. Thus, the structure is simple.

Although the duplex transit tray is defined by the upper surface of the input sheet cassette 4 in the present preferred embodiment, it may alternatively be combined with the output sheet tray 6.

The switchback mechanism transfers the one-side printed sheet onto the surface of the ordinary eject tray and holds the sheet thereon. Thus, the sheet is exposed to air outside of the apparatus so as to expedite drying and to avoid the moist, humid atmosphere inside of the printer which prevents rapid drying of the ink drops on the one-side-printed sheet.

Figure 10:
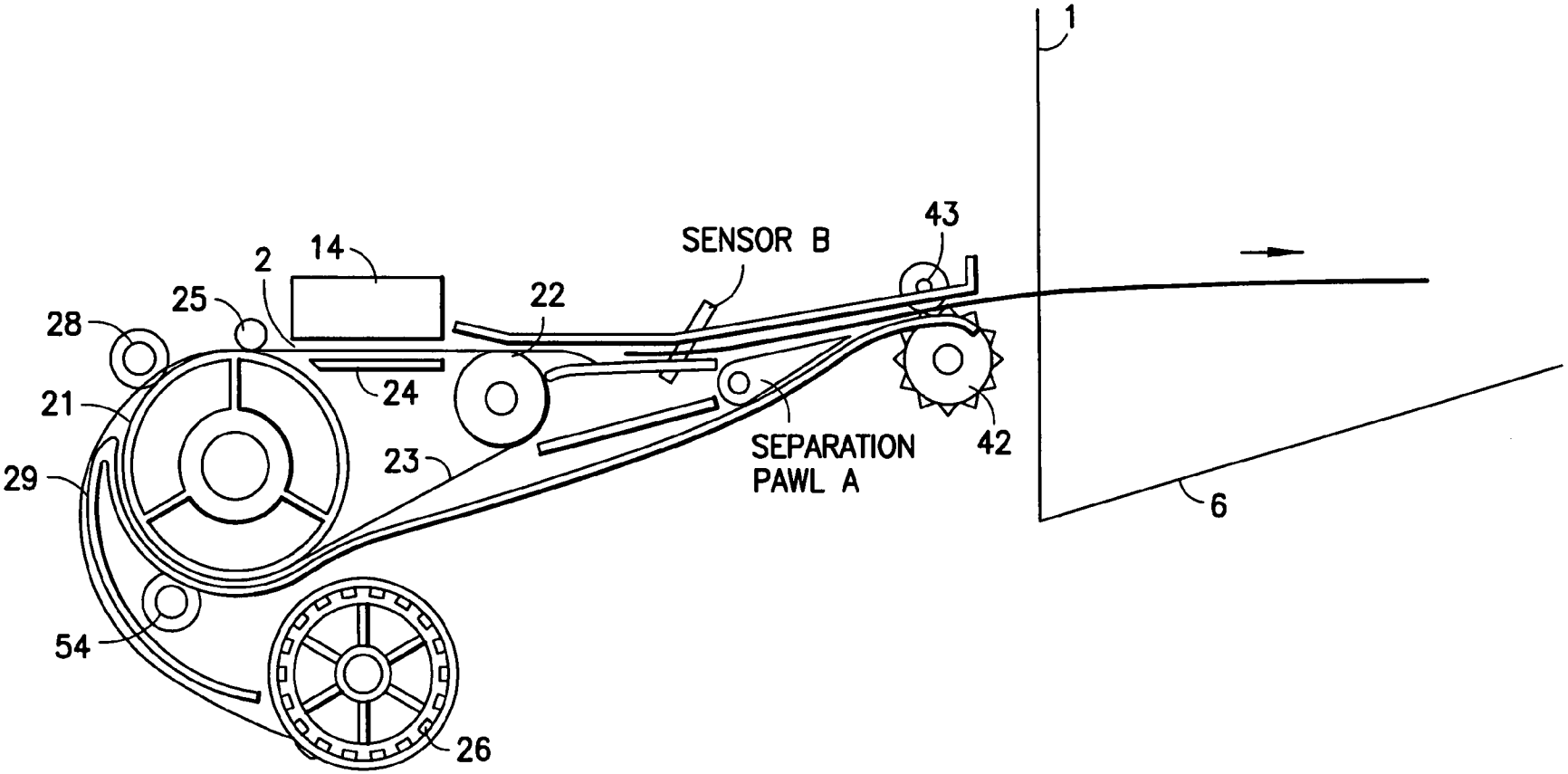
FIG. 10 is another preferred embodiment of the present invention showing an alternative arrangement for feeding the one-side-printed sheet to a location outside of the apparatus.
Figure 11:
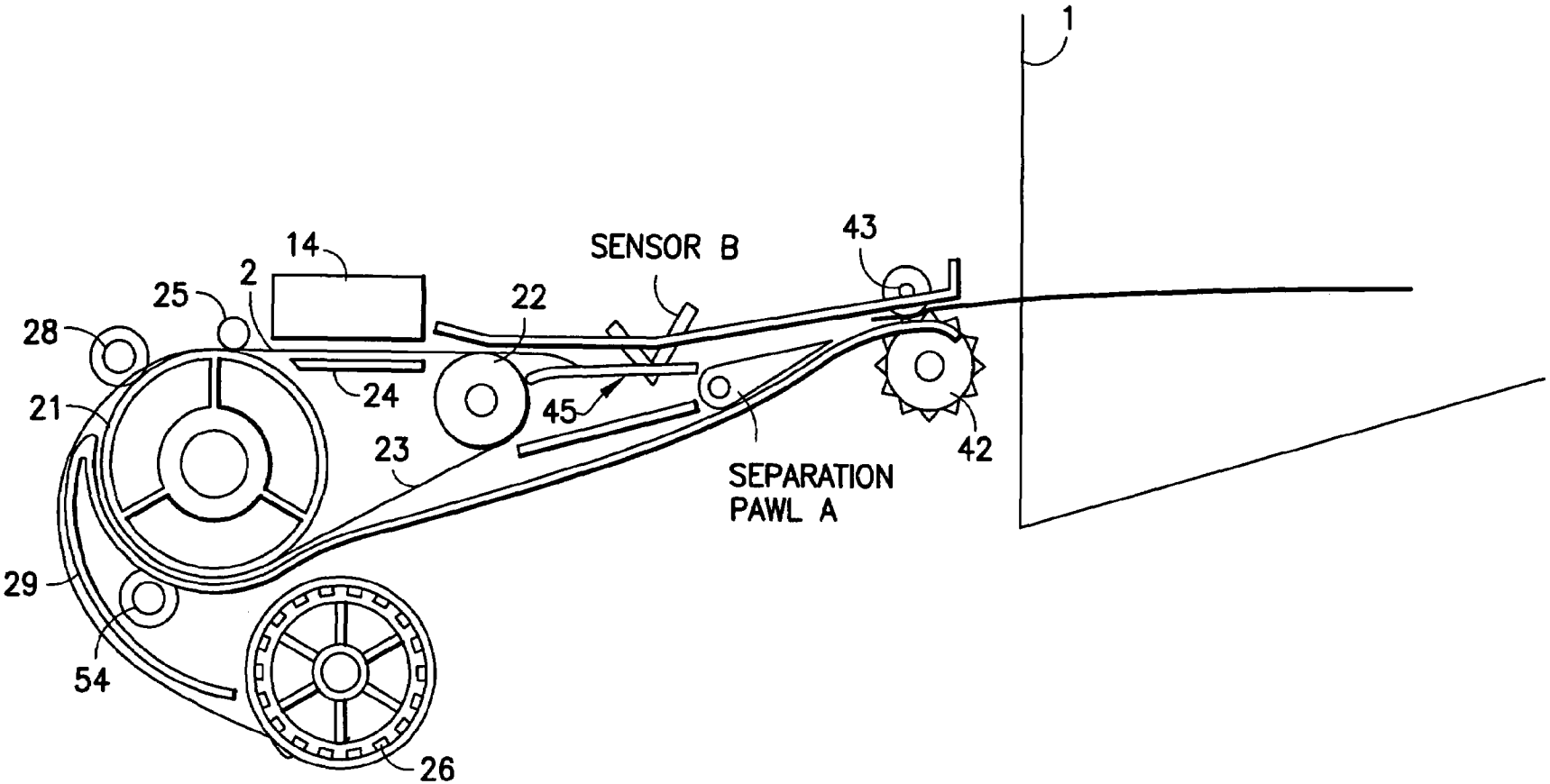
FIG. 11 is another preferred embodiment of the present invention showing an alternative arrangement for feeding the one-side-printed sheet to a location outside of the apparatus including a sensor for sensing the sheet and a separation pawl A in a first position.
Figure 12:
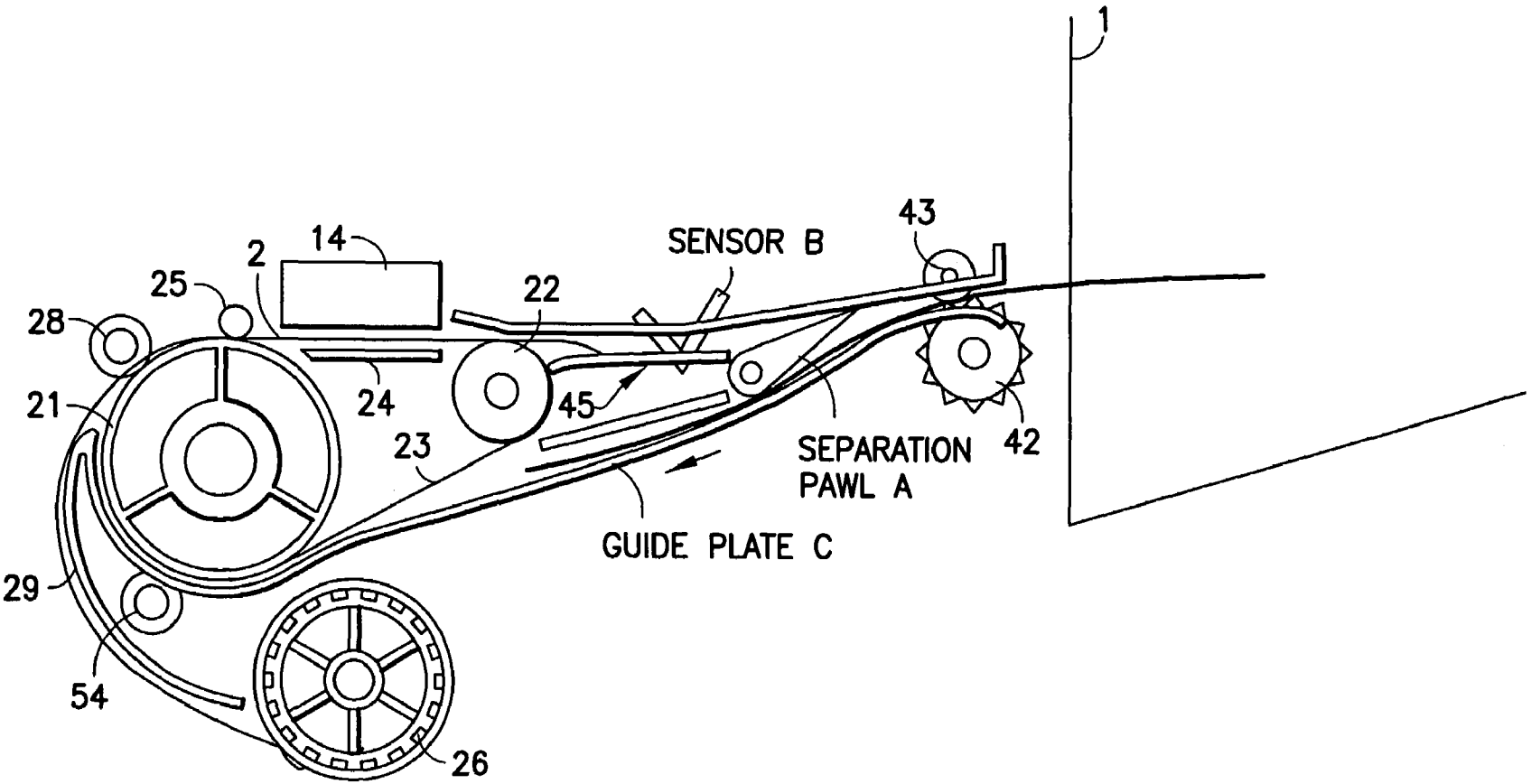
FIG. 12 is another preferred embodiment of the present invention showing an alternative arrangement for feeding the one-side-printed sheet to a location outside of the apparatus including a sensor for sensing the sheet and a separation pawl A in a second position.

Such a switchback mechanism operates in the following manner as seen in FIGS. 10-12.

In the duplex print mode, the sheet 3 which has been transferred to the print position is printed on the front side of the sheet 3 and is further transferred to the ordinary sheet output tray 6, as illustrated in FIG. 10. Thus, in this preferred embodiment, a separate sheet path leading to a location on top of the sheet cassette is not necessary and the sheet output tray can be used to support the one-side-printed sheet thereon before the sheet is fed back into the printer for printing on the second side thereto. During this operation, a separation pawl A is set at a lower position.

A sensor B which is mounted in the paper path between the print head 14 and the separation pawl A, detects a trailing edge of the advancing sheet 3. Upon such a detection, the sheet 3 is advanced further for a predetermined time and is then stopped so that the trailing edge thereof passes the separation pawl A. Then, the eject rollers 42, 43 are activated to hold the sheet 3 at the trailing edge thereof, as illustrated in FIG. 11.

Then, the separation pawl is set to an upper position and the eject rollers 42 and 43 are driven reversely so as to transfer the one-side-printed sheet 3 to the roller 21, as illustrated in FIG. 12.

Then, the sheet 3 is transferred again to the print position and is printed on its back surface. After that, the sheet 3 is transferred to the eject tray 6 and is ejected thereto.

In addition, the time period that the eject rollers 42 and 43 grip the sheet 3 at the trailing edge thereof can be changed according to an operator instruction which may be made in accordance with various factors such as characteristics of ink, sheet, and so on. For example, ink on an ordinary plain paper can be dried more quickly than that on a calendared paper and the operator can normally select a type of sheets when selecting the print operation. If such a time period is not sufficiently provided, the ink of the one-side printed sheet 3 will rub against the separation pawl A and/or guide plate C. As a result, the ink image on the sheet 3 will be negatively affected.

Figure 13:
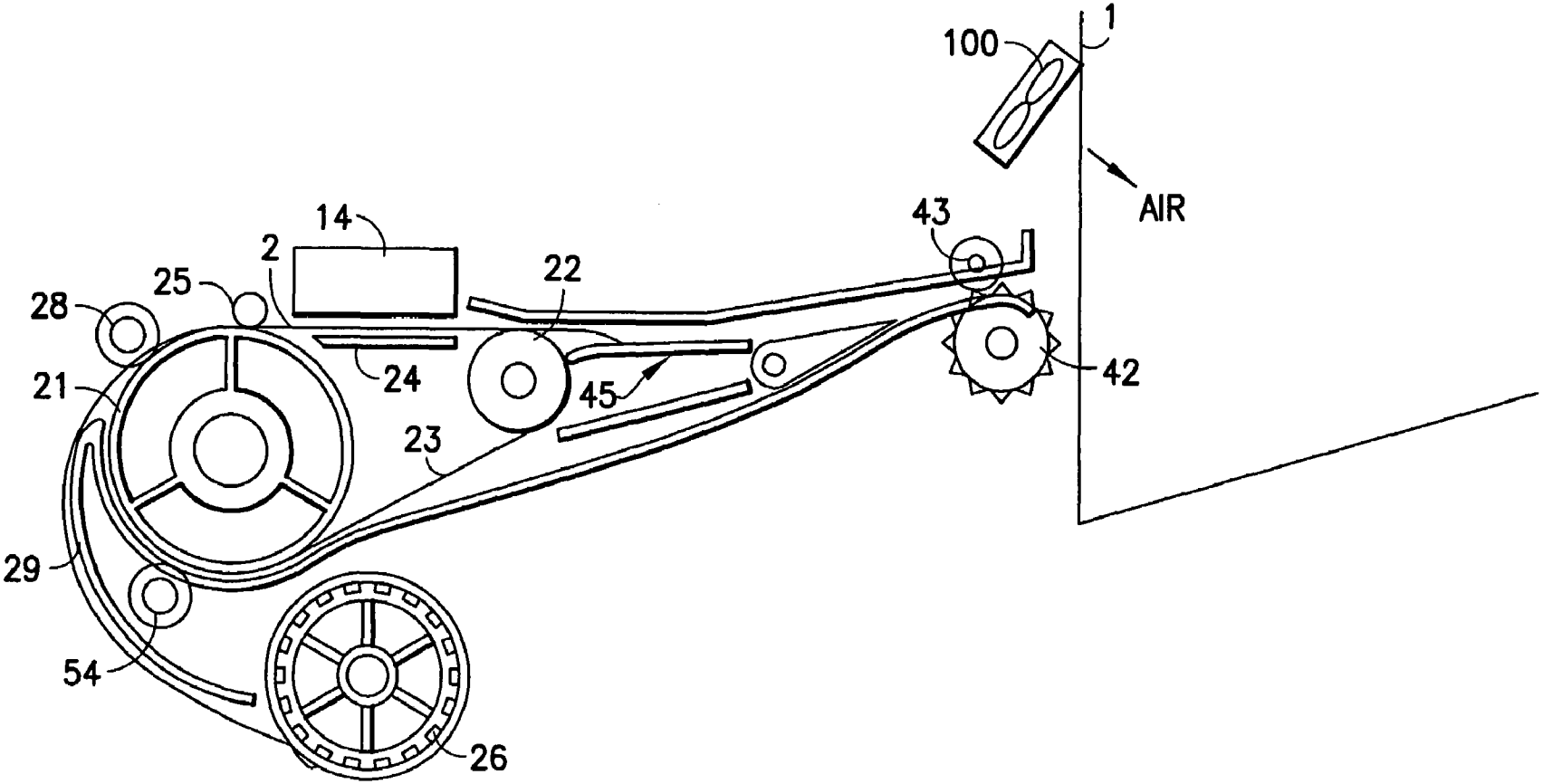
FIG. 13 is a further preferred embodiment of the present invention including a fan for expediting drying of the ink image on the one-side-printed sheet.
Figure 14:
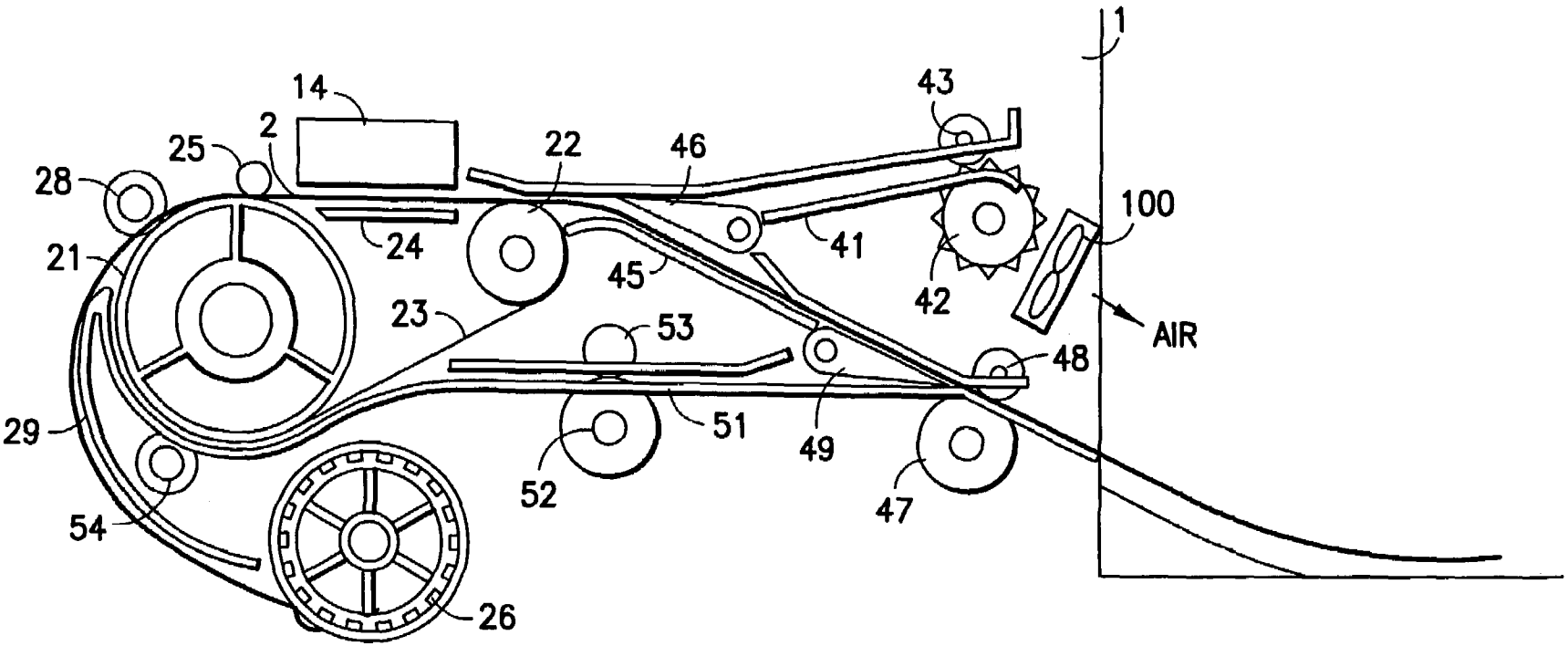
FIG. 14 is a further preferred embodiment of the present invention including an alternative arrangement of a fan for expediting drying of the ink image on the one-side-printed sheet.
Figure 15:
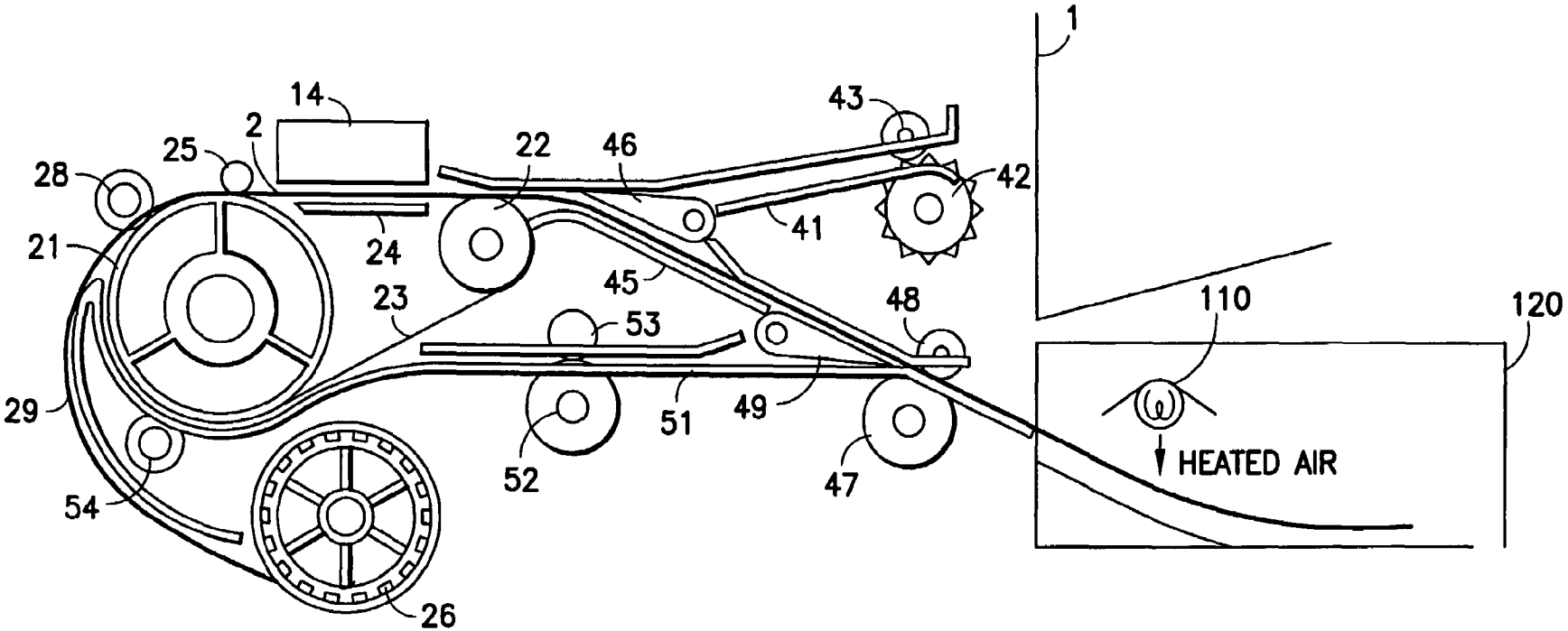
FIG. 15 is an additional preferred embodiment of the present invention including a heater disposed in a separate heating unit outside of the apparatus for expediting drying of the ink image on the one-side-printed sheet.

FIGS. 13-15 show preferred embodiments of the present invention including ink drying mechanisms. When the one-side-printed sheet 3 is to be dried on the eject tray, a fan 100 can be mounted in a position as show in FIG. 13. When the one-side-printed sheet 3 is dried on the paper cassette, a fan 100 can be mounted at a position as shown in FIG. 14.

In conventional devices, for safety reasons, it is difficult to find a safe and reliable configuration to provide a heater to expedite drying the one-side-printed sheet.

However, in a preferred embodiment of the present invention shown in FIG. 15, when the one-sided printed sheet 3 is dried on the paper cassette, a heater 110 can be mounted at a position as shown in FIG. 15. The heater should be located inside of a portion of the printer housing 120 provided with the apparatus for safety reasons.

In describing preferred embodiments of the present invention illustrated in the drawings, specific terminology is used for the sake of clarity. However, the present invention is not intended to be limited to the specific terminology so selected and it is to be understood that each specific element includes all technical equivalents which operate in a similar manner.

Numerous additional modifications and variations of the present invention are possible in light of the above teachings. It is therefore to be understood that within the scope of the appended claims, the present invention may be practiced otherwise than as specifically described herein.

This document claims the priority rights of and is based on the subject matter described in Japanese Patent Application No. 10-165331 filed on Jun. 12, 1998, in the Japanese Patent Office, the entire contents of which are hereby incorporated by reference.

The invention claimed is:

1. An ink jet recording apparatus, comprising:

an ink jet recording head; and a feeding device including an ejection roller; and a housing configured to house said ink jet recording head and said feeding device wherein the feeding device is configured to feed a sheet to said ink jet recording head which ejects ink in a downward direction on said sheet to create a recorded sheet having a first recorded surface, said sheet being kept substantially horizontal at a position opposed to the jet recording head, to feed the sheet having the first recorded surface along a generally horizontal path, the generally horizontal path including a sloped portion, the sloped portion sloping upwardly towards the ejection roller as the recorded sheet proceeds downstream from the inkjet recording head, to hold a portion of the recorded sheet by the ejection roller such that said first recorded surface faces upward for a time for drying said first recorded surface, the ejection roller located downstream of the sloped portion such that the sheet arrives at the sloped portion prior to arriving at the ejection roller, a portion of the recorded sheet extending beyond the ejection roller while the recorded sheet is held by the ejection roller, wherein the feeding device holds the portion of the recorded sheet by the ejection roller such that a part of the sheet is held outside of the housing for the time for drying which is a predetermined period of time for drying the ink jet ink which is on the first recorded surface of the recorded sheet prior to printing on another surface of the sheet which is opposite to the first recorded surface, and to switchback the recorded sheet by the ejection roller to return the recorded sheet upside down to the ink jet recording head for recording on the another surface of the sheet.

2. The apparatus according to claim 1, wherein the ink jet recording head is arranged above a sheet transport path within said housing.

3. The apparatus according to claim 2, wherein the ink jet recording head is detachably mounted in said housing.

4. The apparatus according to claim 3, wherein said housing further comprises:

an openable cover configured to allow access to said ink jet recording head.

5. The apparatus according to claim 1, wherein the feeding device is further configured to eject the two-sided recorded sheet to an ejection position outside of said housing.

6. The apparatus according to claim 1, wherein:

the feeding device is further configured to keep the sheet having the first recorded surface facing upwardly from where the sheet is recorded on by the recording head through a time when the hold is completed.

7. The apparatus according to claim 6, wherein:

the feeding device is further configured to reverse a direction of the sheet to pass back the sheet under the recording head and through a path different from the path used when the sheet is recorded on, when the hold is completed.

8. The apparatus according to claim 1, further comprising:

a tray for holding unrecorded sheets, wherein the feeding device is further configured to remove the sheet from the tray of unrecorded sheets and reverse an orientation of the sheet, prior to feeding the sheet to said ink jet recording head.

9. The apparatus according to claim 1, further comprising:

a paper tray; and a reversing device, configured to reverse an orientation of an unrecorded sheet from the paper tray, prior to the unrecorded sheet being fed to the ink jet recording head, the reversing device further being used to reverse the recorded sheet upside down and to feed the reversed recorded sheet back to the ink jet recording head.

10. An inkjet recording apparatus as claimed in claim 1, wherein the feeding device is further configured to feed a portion of the sheet having the first recorded surface beyond the ejection roller along the generally horizontal path, the ejection roller being provided at an end part of the generally horizontal path which is at a highest point of the sloped portion.

11. An inkjet recording apparatus as claimed in claim 1, wherein a degree of a slope of the sloped portion is generally horizontal such that the sloped path does not reverse an orientation of the recording sheet having the first recorded surface.

12. An ink jet recording apparatus, comprising:

an ink jet recording head;

a feeding device including an ejection roller; and a housing configured to house said ink jet recording head and said feeding device wherein the feeding device is configured to feed a sheet to said ink jet recording head which ejects ink in a downward direction on said sheet to create a recorded sheet having a first recorded surface, said sheet being kept substantially horizontal at a position opposed to the ink jet recording head, to feed the sheet having the first recorded surface to the ejection roller along a generally horizontal path, to hold a portion of the recorded sheet by the ejection roller such that said first recorded surface faces upward for a time for drying said first recorded surface, a part of the recorded sheet extending beyond the ejection roller while the portion of the recorded sheet is held by the ejection roller, wherein the feeding device holds the portion of the recorded sheet by the ejection roller such that a part of the sheet is held outside of the housing for the time for drying which is a predetermined period of time for drying the ink jet ink which is on the first recorded surface of the recorded sheet prior to printing on another surface of the sheet which is opposite to the first recorded surface, and to switchback the recorded sheet by the ejection roller to return the recorded sheet upside down to the ink jet recording head for recording on another surface of the sheet.

* * * * *